US009644156B2

(12) United States Patent
Bourane et al.

(10) Patent No.: US 9,644,156 B2
(45) Date of Patent: May 9, 2017

(54) TARGETED DESULFURIZATION APPARATUS INTEGRATING OXIDATIVE DESULFURIZATION AND HYDRODESULFURIZATION TO PRODUCE DIESEL FUEL HAVING AN ULTRA-LOW LEVEL OF ORGANOSULFUR COMPOUNDS

(71) Applicant: Saudi Arabian Oil Company, Dhahran (SA)

(72) Inventors: Abdennour Bourane, Ras Tanura (SA); Omer Refa Koseoglu, Dhahran (SA); Mohammed Ibrahim Katheeri, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 15/082,717

(22) Filed: Mar. 28, 2016

(65) Prior Publication Data

US 2016/0208179 A1 Jul. 21, 2016

Related U.S. Application Data

(62) Division of application No. 12/724,277, filed on Mar. 15, 2010, now Pat. No. 9,296,960.

(51) Int. Cl.
*C10G 67/12* (2006.01)
*C10G 67/04* (2006.01)
(Continued)

(52) U.S. Cl.
CPC ..... *C10G 67/14* (2013.01); *C10G 27/04* (2013.01); *C10G 27/12* (2013.01); *C10G 45/02* (2013.01);
(Continued)

(58) Field of Classification Search
CPC ..... C10G 67/04; C10G 67/06; C10G 67/12; C10G 67/14
See application file for complete search history.

(56) References Cited

U.S. PATENT DOCUMENTS 2,749,284 A 6/1956 Noble
2,771,401 A 11/1956 Shepard
(Continued)

FOREIGN PATENT DOCUMENTS

GB 773173 A 4/1957
JP 01151748 A 6/2001
(Continued)

OTHER PUBLICATIONS

J. T. Sampanthar et al., A Novel Oxidative Desulfurization Process to Remove Refractory Sulfur Compounds From Diesel Fuel, 63 Appl. Catal., B 85-93 (2006).*
(Continued)

*Primary Examiner* — Randy Boyer
(74) *Attorney, Agent, or Firm* — Abelman, Frayne & Schwab

(57) ABSTRACT

Deep desulfurization of hydrocarbon feeds containing undesired organosulfur compounds to produce a hydrocarbon product having low levels of sulfur, i.e., 15 ppmw or less of sulfur, is achieved by flashing the feed at a target cut point temperature to obtain two fractions. A first fraction contains refractory organosulfur compounds, which boil at or above the target cut point temperature. A second fraction boiling below the target cut point temperature is substantially free of refractory sulfur-containing compounds. The second fraction is contacted with a hydrodesulfurization catalyst in a hydrodesulfurization reaction zone operating under mild conditions to reduce the quantity of organosulfur compounds to an ultra-low level. The first fraction is contacted with an oxidizing agent and an active metal catalyst in an
(Continued)

oxidation reaction zone to convert the refractory organosulfur compounds to oxidized organosulfur compounds. The oxidized organosulfur compounds are removed, producing a stream containing an ultra-low level of organosulfur compounds. The two streams can be combined to obtain a full range hydrocarbon product having an ultra-low level of organosulfur compounds.

7 Claims, 3 Drawing Sheets

(51) Int. Cl.

| | |
|---|---|
| ***C10G 67/06*** | (2006.01) |
| ***C10G 67/14*** | (2006.01) |
| ***C10G 69/14*** | (2006.01) |
| ***C10G 27/04*** | (2006.01) |
| ***C10G 45/02*** | (2006.01) |
| ***C10G 67/16*** | (2006.01) |
| ***C10G 27/12*** | (2006.01) |
| ***C10G 45/08*** | (2006.01) |

(52) U.S. Cl.
CPC ..... *C10G 45/08* (2013.01); *C10G 67/16* (2013.01); *C10G 69/14* (2013.01); *C10G 2300/1055* (2013.01); *C10G 2300/1059* (2013.01); *C10G 2300/202* (2013.01); *C10G 2400/04* (2013.01)

(56) References Cited

U.S. PATENT DOCUMENTS

| | | | | |
|---|---|---|---|---|
| 3,193,495 | A | 7/1965 | Elior et al. | |
| 3,341,448 | A * | 9/1967 | Ford | C10G 67/12 208/208 R |
| 3,551,328 | A | 12/1970 | Cole et al. | |
| 3,565,793 | A | 2/1971 | Herbstman et al. | |
| 3,719,589 | A | 3/1973 | Herbstman et al. | |
| 3,767,563 | A | 10/1973 | Woodle | |
| 3,785,965 | A | 1/1974 | Welty, Jr. | |
| 3,816,301 | A | 6/1974 | Sorgenti | |
| 3,847,800 | A | 11/1974 | Guth et al. | |
| 3,948,763 | A | 4/1976 | Christman et al. | |
| 4,358,361 | A | 11/1982 | Peters | |
| 4,359,450 | A | 11/1982 | Blytas et al. | |
| 4,409,199 | A | 10/1983 | Blytas | |
| 4,494,961 | A | 1/1985 | Venkat et al. | |
| 4,557,821 | A | 12/1985 | Lopez et al. | |
| 4,830,733 | A | 5/1989 | Nagji et al. | |
| 4,976,848 | A | 12/1990 | Johnson | |
| 5,232,854 | A | 8/1993 | Monticello | |
| 5,290,427 | A | 3/1994 | Fletcher et al. | |
| 5,387,523 | A | 2/1995 | Monticello | |
| 5,730,860 | A | 3/1998 | Irvine | |
| 5,753,102 | A | 5/1998 | Funakoshi et al. | |
| 5,824,207 | A | 10/1998 | Lyapin et al. | |
| 5,910,440 | A | 6/1999 | Grossman et al. | |
| 5,914,029 | A | 6/1999 | Verachtert, II | |
| 5,958,224 | A | 9/1999 | Ho et al. | |
| 6,087,544 | A | 7/2000 | Wittenbrink et al. | |
| 6,160,193 | A | 12/2000 | Gore | |
| 6,171,478 | B1 * | 1/2001 | Cabrera | C10G 67/12 208/196 |
| 6,217,748 | B1 | 4/2001 | Hatanaka et al. | |
| 6,218,333 | B1 | 4/2001 | Gabrielov et al. | |
| 6,228,254 | B1 | 5/2001 | Jossens et al. | |
| 6,274,785 | B1 | 8/2001 | Gore | |
| 6,277,271 | B1 * | 8/2001 | Kocal | C10G 67/12 208/196 |
| 6,368,495 | B1 | 4/2002 | Kocal et al. | |
| 6,402,940 | B1 | 6/2002 | Rappas | |
| 6,406,616 | B1 | 6/2002 | Rappas et al. | |
| 6,461,859 | B1 | 10/2002 | Duhalt et al. | |
| 6,495,029 | B1 | 12/2002 | Schorfheide et al. | |
| 6,500,219 | B1 | 12/2002 | Gunnerman | |
| 6,596,177 | B2 | 7/2003 | Sherman | |
| 6,827,845 | B2 | 12/2004 | Gong et al. | |
| 6,841,062 | B2 | 1/2005 | Reynolds | |
| 6,843,906 | B1 | 1/2005 | Eng | |
| 6,875,340 | B2 | 4/2005 | Zong et al. | |
| 7,001,504 | B2 | 2/2006 | Schoonover | |
| 7,122,114 | B2 | 10/2006 | Dean | |
| 7,153,414 | B2 | 12/2006 | De Souza | |
| 7,252,756 | B2 | 8/2007 | Gong et al. | |
| 7,309,416 | B2 | 12/2007 | Fokema et al. | |
| 7,314,545 | B2 | 1/2008 | Karas et al. | |
| 7,347,930 | B2 | 3/2008 | Long et al. | |
| 7,374,666 | B2 * | 5/2008 | Wachs | C07C 7/14816 208/208 R |
| 7,666,297 | B2 | 2/2010 | Lee et al. | |
| 2002/0029997 | A1 | 3/2002 | Rappas et al. | |
| 2002/0035306 | A1 | 3/2002 | Gore et al. | |
| 2002/0144932 | A1 * | 10/2002 | Gong | C10G 53/14 208/212 |
| 2002/0189975 | A1 | 12/2002 | De Souza | |
| 2003/0019794 | A1 | 1/2003 | Schmidt et al. | |
| 2003/0034275 | A1 | 2/2003 | Roberie et al. | |
| 2003/0075483 | A1 | 4/2003 | Stanciulescu et al. | |
| 2003/0085156 | A1 | 5/2003 | Schoonover | |
| 2003/0094400 | A1 | 5/2003 | Levy et al. | |
| 2004/0007501 | A1 | 1/2004 | Sughrue et al. | |
| 2004/0007502 | A1 | 1/2004 | Wismann et al. | |
| 2004/0104144 | A1 | 6/2004 | Hagen et al. | |
| 2004/0108252 | A1 | 6/2004 | De Souza | |
| 2004/0118750 | A1 | 6/2004 | Gong et al. | |
| 2004/0154959 | A1 | 8/2004 | Schoebrechts et al. | |
| 2004/0222131 | A1 | 11/2004 | Cullen | |
| 2004/0222134 | A1 | 11/2004 | de Souza | |
| 2005/0040078 | A1 | 2/2005 | Zinnen et al. | |
| 2005/0109678 | A1 | 5/2005 | Ketley et al. | |
| 2005/0150819 | A1 | 7/2005 | Wachs | |
| 2005/0218038 | A1 | 10/2005 | Nero et al. | |
| 2006/0021913 | A1 | 2/2006 | Ketley et al. | |
| 2006/0054535 | A1 | 3/2006 | Leung et al. | |
| 2006/0054537 | A1 | 3/2006 | Cholley et al. | |
| 2006/0081501 | A1 | 4/2006 | Kozyuk | |
| 2006/0108263 | A1 | 5/2006 | Lin | |
| 2006/0131214 | A1 | 6/2006 | de Souza et al. | |
| 2006/0144761 | A1 | 7/2006 | Keckler et al. | |
| 2006/0154814 | A1 | 7/2006 | Zanibelli et al. | |
| 2006/0180501 | A1 | 8/2006 | Da Silva et al. | |
| 2007/0012184 | A1 | 1/2007 | Duraiswamy et al. | |
| 2007/0051667 | A1 | 3/2007 | Martinie et al. | |
| 2007/0102323 | A1 | 5/2007 | Lee et al. | |
| 2007/0151901 | A1 | 7/2007 | Sain et al. | |
| 2007/0227947 | A1 | 10/2007 | Reynolds | |
| 2007/0227951 | A1 * | 10/2007 | Thirugnanasampanthar | C10G 21/06 208/243 |
| 2008/0099375 | A1 | 5/2008 | Landau et al. | |
| 2008/0116112 | A1 | 5/2008 | Umansky et al. | |
| 2008/0149533 | A1 | 6/2008 | Yoo et al. | |
| 2008/0308463 | A1 | 12/2008 | Keckler et al. | |
| 2009/0065399 | A1 | 3/2009 | Kocal et al. | |
| 2009/0200206 | A1 * | 8/2009 | Al-Shahrani | C10G 17/02 208/222 |

FOREIGN PATENT DOCUMENTS

| | | | |
|---|---|---|---|
| JP | 2004196927 | A | 7/2004 |
| WO | 9856875 | A1 | 12/1998 |
| WO | 0218518 | A1 | 3/2002 |
| WO | 0226916 | A1 | 4/2002 |
| WO | 02074884 | A1 | 9/2002 |
| WO | 03004412 | A1 | 1/2003 |
| WO | 03014266 | A1 | 2/2003 |
| WO | 03035800 | A2 | 10/2003 |
| WO | 2004005435 | A1 | 1/2004 |
| WO | 2005012458 | A1 | 2/2005 |
| WO | 2005040308 | A2 | 5/2005 |
| WO | 2005061675 | A1 | 7/2005 |

(56) References Cited

FOREIGN PATENT DOCUMENTS

| | | | |
|---|---|---|---|
| WO | 2006071793 | A1 | 7/2006 |
| WO | 2007103440 | A2 | 9/2007 |
| WO | 2007106943 | A1 | 9/2007 |

OTHER PUBLICATIONS

A. Marafi et al., "Deep Desulfurization of Full Range and Low Boiling Diesel Streams From Kuwait Lower Fars Heavy Crude." Fuel Processing Technology, vol. 88, Issue 9, Sep. 2007, 905-911.
Antonio Chica et al., "Catalytic Oxidative Desulfurization (ODS) of Diesel Fuel on a Continuous Fixed-Bed Reactor." Journal of Catalysis, vol. 242, Issue 2, Sep. 10, 2006, 299-308.
Arturo J. Hernández-Maldonado et al., "Desulfurization of Commercial Fuels by π-Complexation: Monolayer CuCl/γ-Al2O3." Applied Catalysis B: Environmental, vol. 61, Issues 3-4, Nov. 9, 2005, 212-218.
Chang Hyun Ko et al., "Adsorptive Desulfurization of Diesel Using Metallic Nickel Supported on SBA-15 as Adsorbent." Studies in Surface Science and Catalysis, vol. 165, 2007, 881-884.
Chunshan Song et al., "New Design Approaches to Ultra-Clean Diesel Fuels by Deep Desulfurization and Deep Dearomatization." Applied Catalysis B: Environmental, vol. 41, Issues 1-2, Mar. 10, 2003, 207-238.
Chunshan Song, "An Overview of New Approaches to Deep Desulfurization for Ultra-Clean Gasoline, Diesel Fuel and Jet Fuel." Catalysis Today, vol. 86, Issues 1-4, Nov. 1, 2003, 211-263.
Esteban Pedemera et al., "Deep Desulfurization of Middle Distillates: Process Adaptation to Oil Fractions' compositions." Catalysis Today, vols. 79-80, Apr. 30, 2003, 371-381.
F. Villaseñor et al., "Oxidation of Dibenzothiophene by Laccase or Hydrogen Peroxide and Deep Desulfurization of Diesel Fuel by the Later." Fuel Processing Technology, vol. 86, Issue 1, Nov. 15, 2004, 49-59.
Farhan Al-Shahrani et al., "Desulfurization of Diesel Via the H202 Oxidation of Aromatic Sulfides to Sulfones Using a Tungstate Catalyst." Applied Catalysis B: Environmental, vol. 73, 3-4, May 11, 2007, 311-316.
Guoxian Yu et al., "Diesel Fuel Desulfurization With Hydrogen Peroxide Promoted by Formic Acid and Catalyzed by Activated Carbon." Carbon, vol. 43, Issue 11, Sep. 2005, 2285-2294.
Hai Mei et al., "A New Method for Obtaining Ultra-Low Sulfur Diesel Fuel Via Ultrasound Assisted Oxidative Desulfurization." Fuel, vol. 82, Issue 4, Mar. 2003, 405-414.
Hongying Lü et al., "Ultra-Deep Desulfurization of Diesel by Selective Oxidation With [C18H37N(CH3)3]4 [H2NPW10O36] Catalyst Assembled in Emulsion Droplets." Journal of Catalysis, vol. 239, Issue 2, Apr. 25, 2006, 369-375.
Isao Mochida et al., "Deep Hydrodesulfurization of Diesel Fuel: Design of Reaction Process and Catalysis." Catalysis Today, vol. 29, Issues 1-4, May 31, 1996, 185-189.
Jeyagowry T. Sampanthar et al., "A Novel Oxidative Desulfurization Process to Remove Refractory Sulfur-Compounds From Diesel Fuel." Applied Catalysis B: Environmental, vol. 63, Issues 1-2, Mar. 22, 2006, 85-93.
Jinbo Gao et al., "Deep Desulfurization From Fuel Oil Via Selective Oxidation Using an Amphiphilic Peroxotungsten Catalyst Assembled in Emulsion Droplets." Journal of Molecular Catalysis A: Chemical, vol. 258, Issues 102, Oct. 2, 2006, 261-266.
José Luis García-Gutiérrez et al., "Ultra-Deep Oxidative Desulfurization of Diesel Fuel by the Mo/Al2O3—H2O2 System: The Effect of System Parameters on Catalytic Activity." Applied Catalysis A, General, vol. 334, Issues 1-2, Jan. 1, 2008, 366-373.
José Luis García-Gutiérrez et al., "Ultra-Deep Oxidative Desulfurization of Diesel Fuel With H2O2 Catalyzed Under Mild Conditions by Polymolybdates Supported on Al2O3." Applied Catalysis A: General, vol. 305, Issue 1 May 17, 2006, 15-20.
Lawrence K. Wang et al., "Desulfurization and Emissions Control." Book Advanced Air and Noise Pollution Control, Handbook of Environmental Engineering, vol. 2, 2005, 35-95, Humana Press.
Luis Cedeño Caero et al., "Oxidative Desulfurization of Synthetic Diesel Using Supported Catalysts: Part 1. Study of the Operation Conditions With a Vanadium Oxide Based Catalyst." Catalysis Today, vols. 107-108, Oct. 30, 2005, 564-569.
Luis Cedeño Caero et al., "Oxidative Desulfurization of Synthetic Diesel Using Supported Catalysts: Part II Effect of Oxidant and Nitrogen-Compounds on Extraction-Oxidation Process." Catalysis Today, vol. 116, Issue 4, Sep. 15, 2006, 562-568.
Luis Cedeño-Caero et al., "Oxidative Desulfurization of Synthetic Diesel Using Supported Catalysts: Part III. Support Effect on Vanadium-Based Catalysts." Catalysis Today, 133-135, Apr.-Jun. 2008, 244-254.
M.V. Landau et al., "Tail-Selective Hydrocracking of Heavy Gas Oil in Diesel Production." Studies in Surface Science and Catalysis, vol. 106, 1997, 371-378.
Perry, R. H.; Green D.W. (1997). Perry's Chemical Engineers' Handbook (7th Edition), Ch. 13: Distillation, Seader et al.
Petr Steiner et al., "Catalytic hydrodesulfurization of a light gas oil over a NiMo catalyst: kinetics of selected sulfur components." Fuel Processing Technology, vol. 79, Issue 1, Aug. 2, 2002, 1-12.
Pysh'yev, Serhiy. "Application of Non-Catalytic Oxidative Desulphurization Process for Obtaining Diesel Fuels with Improved Lubricity", Chemistry & Chemical Technology, vol. 6 No. 2, 2012, pp. 229-235.
Ruixiang Hua et al., "Determination of sulfur-containing compounds in diesel oils by comprehensive two-dimensional gas chromatography with a sulfur chemiluminescence detector." Journal of Chromatography, vol. 1019, Issues 1-2, Nov. 2003, 101-109.
Shujiro Otsuki et al., "Oxidative desulfurization of light gas oil and vacuum gas oil by oxidation and solvent extraction." Energy Fuels, 14, 2000, 1232-1239.
Shuzhi Liu et al., "Deep Desulfurization of Diesel Oil Oxidized by Fe (VI) Systems". Fuel, vol. 87, Issue 3, Mar. 2008, 422-428.
Sujit Mondal et al., "Oxidation of Sulfur Components in Diesel Fuel Using Fe-TAML® Catalysts and Hydrogen Peroxide." Catalysis Today, vol. 116, Issue 4, Sep. 15, 2006, 554-561.
Vinay M. Bhandari et al., "Desulfurization of Diesel Using Ion-Exchanges Zeolites." Chemical Engineering Science, vol. 61, Issue 8, Apr. 2006, 2599-2608.
Wei Dai et al., "Desulfurization of Transportation Fuels Targeting at Removal of Thiophene/Benzothiophene." Fuel Processing Technology. In Press, Corrected Proof. Web. Mar. 4, 2008, 749-755.
Xiaoliang Ma et al., "A New Approach to Deep Desulfurization of Gasoline, Diesel Fuel and Jet Fuel by Selective Adsorption for Ultra-Clean Fuels and for Fuel Cell Applications." Catalysis Today, 2002, 77, 1-2, 107-116.
Yosuke Sano et al., "Two-Step Adsorption Process for Deep Desulfurization of Diesel Oil." Fuel, vol. 84, Issues 1-8, May 2005, 903-910.
International Search Report mailed on Mar. 30, 2011 by the ISA/US in application No. PCT/US11/23858, pp. 1-8.

* cited by examiner

TARGETED DESULFURIZATION APPARATUS INTEGRATING OXIDATIVE DESULFURIZATION AND HYDRODESULFURIZATION TO PRODUCE DIESEL FUEL HAVING AN ULTRA-LOW LEVEL OF ORGANOSULFUR COMPOUNDS

RELATED APPLICATIONS

The present application is a divisional application under 35 USC §120 of U.S. application Ser. No. 12/724,277 filed on Mar. 15, 2010, which is presently pending and is incorporated by reference in its entirety in the present application

BACKGROUND OF THE INVENTION

Field of the Invention

The present invention relates to integrated oxidative desulfurization processes to efficiently reduce the sulfur content of hydrocarbons, and more particularly to the deep desulfurization of hydrocarbons, including diesel fuel, to produce fuels having ultra-low sulfur levels.

Description of Related Art

The discharge into the atmosphere of sulfur compounds during processing and end-use of the petroleum products derived from sulfur-containing sour crude oil pose health and environmental problems. The stringent reduced-sulfur specifications applicable to transportation and other fuel products have impacted the refining industry, and it is necessary for refiners to make capital investments to greatly reduce the sulfur content in gas oils to 10 parts per million by weight (ppmw) or less. In the industrialized nations such as the United States, Japan and the countries of the European Union, refineries for transportation fuel have already been required to produce environmentally clean transportation fuels. For instance, in 2007 the United States Environmental Protection Agency required the sulfur content of highway diesel fuel to be reduced 97%, from 500 ppmw (low sulfur diesel) to 15 ppmw (ultra-low sulfur diesel). The European Union has enacted even more stringent standards, requiring diesel and gasoline fuels sold in 2009 to contain less than 10 ppmw of sulfur. Other countries are following in the footsteps of the United States and the European Union and are moving forward with regulations that will require refineries to produce transportation fuels with an ultra-low sulfur level.

To keep pace with recent trends toward production of ultra-low sulfur fuels, refiners must choose among the processes or crude oils that provide flexibility that ensures future specifications are met with minimum additional capital investment, in many instances by utilizing existing equipment. Conventional technologies such as hydrocracking and two-stage hydrotreating offer solutions to refiners for the production of clean transportation fuels. These technologies are available and can be applied as new grassroots production facilities are constructed. However, many existing hydroprocessing facilities, such as those using relatively low pressure hydrotreaters, represent a substantial prior investment and were constructed before these more stringent sulfur reduction requirements were enacted. It is very difficult to upgrade existing hydrotreating reactors in these facilities because of the comparatively more severe operational requirements (i.e., higher temperature and pressure) to obtain clean fuel production. Available retrofitting options for refiners include elevation of the hydrogen partial pressure by increasing the recycle gas quality, utilization of more active catalyst compositions, installation of improved reactor components to enhance liquid-solid contact, the increase of reactor volume, and the increase of the feedstock quality.

There are many hydrotreating units installed worldwide producing transportation fuels containing 500-3000 ppmw sulfur. These units were designed for, and are being operated at, relatively mild conditions (i.e., low hydrogen partial pressures of 30 kilograms per square centimeter for straight run gas oils boiling in the range of 180 C.°-370° C.).

However, with the increasing prevalence of more stringent environmental sulfur specifications in transportation fuels mentioned above, the maximum allowable sulfur levels are being reduced to no greater than 15 ppmw, and in some cases no greater than 10 ppmw. This ultra-low level of sulfur in the end product typically requires either construction of new high pressure hydrotreating units, or a substantial retrofitting of existing facilities, e.g., by integrating new reactors, incorporating gas purification systems, reengineering the internal configuration and components of reactors, and/or deployment of more active catalyst compositions.

Sulfur-containing compounds that are typically present in hydrocarbon fuels include aliphatic molecules such as sulfides, disulfides and mercaptans as well as aromatic molecules such as thiophene, benzothiophene and its long chain alkylated derivatives, and dibenzothiophene and its alkyl derivatives such as 4,6-dimethyldibenzothiophene. Aromatic sulfur-containing molecules have a higher boiling point than aliphatic sulfur-containing molecules, and are consequently more abundant in higher boiling fractions.

In addition, certain fractions of gas oils possess different properties. The following table illustrates the properties of light and heavy gas oils derived from Arabian Light crude oil:

TABLE 1

| Feedstock Name | | Light | Heavy |
|---|---|---|---|
| Blending Ratio | | — | — |
| API Gravity | ° | 37.5 | 30.5 |
| Carbon | W % | 85.99 | 85.89 |
| Hydrogen | W % | 13.07 | 12.62 |
| Sulfur | W % | 0.95 | 1.65 |
| Nitrogen | ppmw | 42 | 225 |
| ASTM D86 Distillation | | | |
| IBP/5 V % | ° C. | 189/228 | 147/244 |
| 10/30 V % | ° C. | 232/258 | 276/321 |
| 50/70 V % | ° C. | 276/296 | 349/373 |
| 85/90 V % | ° C. | 319/330 | 392/398 |
| 95 V % | ° C. | 347 | |
| Sulfur Speciation | | | |
| Organosulfur Compounds Boiling Less than 310° C. | ppmw | 4591 | 3923 |
| Dibenzothiophenes | ppmw | 1041 | 2256 |
| $C_1$-Dibenzothiophenes | ppmw | 1441 | 2239 |
| $C_2$-Dibenzothiophenes | ppmw | 1325 | 2712 |
| $C_3$-Dibenzothiophenes | ppmw | 1104 | 5370 |

As set forth above in Table 1, the light and heavy gas oil fractions have ASTM D85 95 V % point of 319° C. and 392° C., respectively. Further, the light gas oil fraction contains less sulfur and nitrogen than the heavy gas oil fraction (0.95 W % sulfur as compared to 1.65 W % sulfur and 42 ppmw nitrogen as compared to 225 ppmw nitrogen).

Advanced analytical techniques such as multi-dimensional gas chromatography (Hua R., Li Y., Liu W., Zheng J., Wei H., Wang J., LU X., Lu X., Kong H., Xu G., Journal of Chromatography A, 1019 (2003) 101-109) with a sulfur chemiluminescence detector have shown that the middle distillate cut boiling in the range of 170-400° C. contains sulfur species including thiols, sulfides, disulfides, thiophenes, benzothiophenes, dibenzothiophenes, and benzonaphthothiophenes, with and without alkyl substituents.

The sulfur speciation and content of light and heavy gas oils are conventionally analyzed by two methods. In the first method, sulfur species are categorized based on structural groups. The structural groups include one group having sulfur-containing compounds boiling at less than 310° C., including dibenzothiophenes and its alkylated isomers, and another group including 1-, 2- and 3-methyl-substituted dibenzothiophenes, denoted as $C_1$, $C_2$ and $C_3$, respectively. Base on this method, the heavy gas oil fraction contains more alkylated di-benzothiophene molecules than the light gas oils.

In the second method of analyzing sulfur content of light and heavy gas oils, and referring to FIG. 1, the cumulative sulfur concentrations are plotted against the boiling points of the sulfur-containing compounds to observe concentration variations and trends. Note that the boiling points depicted are those of detected sulfur-containing compounds, rather than the boiling point of the total hydrocarbon mixture. The boiling point of the key sulfur-containing compounds consisting of dibenzothiophenes, 4-methydibenzothiophenes and 4,6-dimethyldibenzothiophenes are also shown in FIG. 1 for convenience. The cumulative sulfur specification curves show that the heavy gas oil fraction contains a higher content of heavier sulfur-containing compounds and lower content of lighter sulfur-containing compounds as compared to the light gas oil fraction. For example, it is found that 5370 ppmw of $C_3$-dibenzothiophene, and bulkier molecules such as benzonaphthothiophenes, are present in the heavy gas oil fraction, compared to 1104 ppmw in the light gas oil fraction. In contrast, the light gas oil fraction contains a higher content of light sulfur-containing compounds compared to heavy gas oil. Light sulfur-containing compounds are structurally less bulky than dibenzothiophenes and boil at less than 310° C. Also, twice as much $C_1$ and $C_2$ alkyl-substituted dibenzothiophenes exist in the heavy gas oil fraction as compared to the light gas oil fraction.

Aliphatic sulfur-containing compounds are more easily desulfurized (labile) using conventional hydrodesulfurization methods. However, certain highly branched aliphatic molecules can hinder the sulfur atom removal and are moderately more difficult to desulfurize (refractory) using conventional hydrodesulfurization methods.

Among the sulfur-containing aromatic compounds, thiophenes and benzothiophenes are relatively easy to hydrodesulfurize. The addition of alkyl groups to the ring compounds increases the difficulty of hydrodesulfurization. Dibenzothiophenes resulting from addition of another ring to the benzothiophene family are even more difficult to desulfurize, and the difficulty varies greatly according to their alkyl substitution, with di-beta substitution being the most difficult to desulfurize, thus justifying their "refractory" appellation. These beta substituents hinder exposure of the heteroatom to the active site on the catalyst.

The economical removal of refractory sulfur-containing compounds is therefore exceedingly difficult to achieve, and accordingly removal of sulfur-containing compounds in hydrocarbon fuels to an ultra-low sulfur level is very costly by current hydrotreating techniques. When previous regulations permitted sulfur levels up to 500 ppmw, there was little need or incentive to desulfurize beyond the capabilities of conventional hydrodesulfurization, and hence the refractory sulfur-containing compounds were not targeted. However, in order to meet the more stringent sulfur specifications, these refractory sulfur-containing compounds must be substantially removed from hydrocarbon fuels streams.

Relative reactivities of sulfur-containing compounds based on their first order reaction rates at 250° C. and 300° C. and 40.7 Kg/cm$^2$ hydrogen partial pressure over Ni—Mo/alumina catalyst, and activation energies, are given in Table 2 (Steiner P. and Blekkan E. A., Fuel Processing Technology 79 (2002) 1-12).

TABLE 2

| Name | Dibenzothiophene | 4-methy-dibenzo-thiophene | 4,6-dimethy-dibenzo-thiophene |
|---|---|---|---|
| Structure | 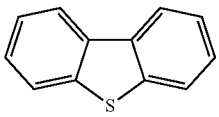 | 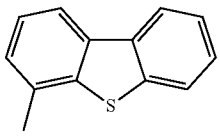 | 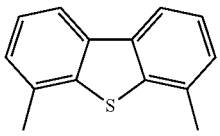 |
| Reactivity $k_{@250}$, $s^{-1}$ | 57.7 | 10.4 | 1.0 |
| Reactivity $k_{@300}$, $s^{-1}$ | 7.3 | 2.5 | 1.0 |
| Activation Energy $E_a$, Kcal/mol | 28.7 | 36.1 | 53.0 |

As is apparent from Table 2, dibenzothiophene is 57 times more reactive than the refractory 4, 6-dimethyldibenzothiophene at 250° C. The relative reactivity decreases with increasing operating severity. With a 50° C. temperature increase, the relative reactivity of di-benzothiophene compared to 4, 6-dibenzothiophene decreases to 7.3 from 57.7.

The development of non-catalytic processes for desulfurization of petroleum distillate feedstocks has been widely studied, and certain conventional approaches are based on oxidation of sulfur-containing compounds are described, e.g., in U.S. Pat. Nos. 5,910,440, 5,824,207, 5,753,102, 3,341,448 and 2,749,284.

Oxidative desulfurization as applied to middle distillates is attractive for several reasons. First, mild reaction conditions, e.g., temperature from room temperature up to 200° C. and pressure from 1 up to 15 atmospheres, are normally used, thereby resulting a priori in reasonable investment and operational costs, especially for hydrogen consumption which is usually expensive. Another attractive aspect is related to the reactivity of high aromatic sulfur-containing species. This is evident since the high electron density at the sulfur atom caused by the attached electron-rich aromatic rings, which is further increased with the presence of additional alkyl groups on the aromatic rings, will favor its electrophilic attack as shown in Table 3 (S. Otsuki, T. Nonaka, N. Takashima, W. Qian, A. Ishihara, T. Imai and T.

Kabe, Energy Fuels 14 (2000) 1232). However, the intrinsic reactivity of molecules such as 4, 6-DMBT should be substantially higher than that of DBT, which is much easier to desulfurize by hydrodesulfurization.

TABLE 3

Electron Density of selected sulfur species

| Sulfur compound | Formulas | Electron Density | K (L/(mol.min)) |
|---|---|---|---|
| Thiophenol | 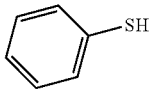 | 5.902 | 0.270 |
| Methyl Phenyl Sulfide | 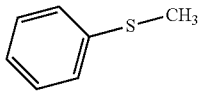 | 5.915 | 0.295 |
| Diphenyl Sulfide | 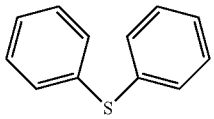 | 5.860 | 0.156 |
| 4,6-DMDBT | 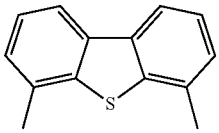 | 5.760 | 0.0767 |
| 4-MDBT | 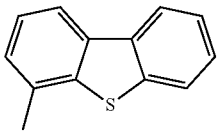 | 5.759 | 0.0627 |
| Dibenzothiophene | 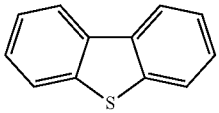 | 5.758 | 0.0460 |
| Benzothiophene | 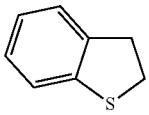 | 5.739 | 0.00574 |
| 2,5-Dimethylthiophene | 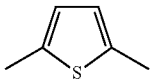 | 5.716 | — |
| 2-methylthiophene | 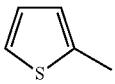 | 5.706 | — |
| Thiophene | 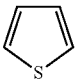 | 5.696 | — |

Certain existing desulfurization processes incorporate both hydrodesulfurization and oxidative desulfurization. For instance, Cabrera et al. U.S. Pat. No. 6,171,478 describes an integrated process in which the hydrocarbon feedstock is first contacted with a hydrodesulfurization catalyst in a hydrodesulfurization reaction zone to reduce the content of certain sulfur-containing molecules. The resulting hydrocarbon stream is then sent in its entirety to an oxidation zone containing an oxidizing agent where residual sulfur-containing compounds are converted into oxidized sulfur-containing compounds. After decomposing the residual oxidizing agent, the oxidized sulfur-containing compounds are solvent extracted, resulting in a stream of oxidized sulfur-containing compounds and a reduced-sulfur hydrocarbon oil stream. A final step of adsorption is carried out on the latter stream to further reduce the sulfur level.

Kocal U.S. Pat. No. 6,277,271 also discloses a desulfurization process integrating hydrodesulfurization and oxidative desulfurization. A stream composed of sulfur-containing hydrocarbons and a recycle stream containing oxidized sulfur-containing compounds is introduced in a hydrodesulfurization reaction zone and contacted with a hydrodesulfurization catalyst. The resulting hydrocarbon stream containing a reduced sulfur level is contacted in its entirety with an oxidizing agent in an oxidation reaction zone to convert the residual sulfur-containing compounds into oxidized sulfur-containing compounds. The oxidized sulfur-containing compounds are removed in one stream and a second stream of hydrocarbons having a reduced concentration of oxidized sulfur-containing compounds is recovered. Like the process in Cabrera et al., the entire hydrodesulfurized effluent is subjected to oxidation in the Kocal process.

Wittenbrink et al. U.S. Pat. No. 6,087,544 discloses a desulfurization process in which a distillate feedstream is first fractionated into a light fraction containing from about 50 to 100 ppm of sulfur, and a heavy fraction. The light fraction is passed to a hydrodesulfurization reaction zone. Part of the desulfurized light fraction is then blended with half of the heavy fraction to produce a low sulfur distillate fuel. However, not all of the distillate feedstream is recovered to obtain the low sulfur distillate fuel product, resulting in a substantial loss of high quality product yield.

Rappas et al. PCT Publication WO02/18518 discloses a two-stage desulfurization process located downstream of a hydrotreater. After having been hydrotreated in a hydrodesulfurization reaction zone, the entire distillate feedstream is introduced to an oxidation reaction zone to undergo biphasic oxidation in an aqueous solution of formic acid and hydrogen peroxide. Thiophenic sulfur-containing compounds are converted to corresponding sulfones. Some of the sulfones are retained in the aqueous solution during the oxidation reaction, and must be removed by a subsequent phase separation step. The oil phase containing the remaining sulfones is subjected to a liquid-liquid extraction step. In the process of WO02/18518, like Cabrera et al. and Kocal, the entire hydrodesulfurized effluent is subject to oxidation reactions, in this case biphasic oxidation.

Levy et al. PCT Publication WO03/014266 discloses a desulfurization process in which a hydrocarbon stream having sulfur-containing compounds is first introduced to an oxidation reaction zone. Sulfur-containing compounds are oxidized into the corresponding sulfones using an aqueous oxidizing agent. After separating the aqueous oxidizing agent from the hydrocarbon phase, the resulting hydrocarbon stream is passed to a hydrodesulfurization step. In the process of WO03/014266, the entire effluent of the oxidation reaction zone is subject to hydrodesulfurization.

Gong et al. U.S. Pat. No. 6,827,845 discloses a three-step process for removal of sulfur- and nitrogen-containing compounds in a hydrocarbon feedstock. All or a portion of the feedstock is a product of a hydrotreating process. In the first step, the feed is introduced to an oxidation reaction zone containing peracid that is free of catalytically active metals. Next, the oxidized hydrocarbons are separated from the acetic acid phase containing oxidized sulfur and nitrogen compounds. In this reference, a portion of the stream is subject to oxidation. The highest cut point identified is 316° C. In addition, this reference explicitly avoids catalytically active metals in the oxidation zone, which necessitates an increased quantity of peracid and more severe operating conditions. For instance, the $H_2O_2$:S molar ratio in one of the examples is 640, which is extremely high as compared to oxidative desulfurization with a catalytic system.

Gong et al. U.S. Pat. No. 7,252,756 discloses a process for reducing the amount of sulfur- and/or nitrogen-containing compounds for refinery blending of transportation fuels. A hydrocarbon feedstock is contacted with an immiscible phase containing hydrogen peroxide and acetic acid in an oxidation zone. After a gravity phase separation, the oxidized impurities are extracted with aqueous acetic acid. A hydrocarbon stream having reduced impurities is recovered, and the acetic acid phase effluents from the oxidation and the extraction zones are passed to a common separation zone for recovery of the acetic acid. In an optional embodiment of U.S. Pat. No. 7,252,756, the feedstock to the oxidation process can be a low-boiling component of a hydrotreated distillate. This reference contemplates subjecting the low boiling fraction to the oxidation zone.

None of the above-mentioned references describe a suitable and cost-effective process for desulfurization of hydrocarbon fuel fractions with specific sub-processes and apparatus for targeting different organosulfur compounds. In particular, conventional methods do not fractionate a hydrocarbon fuel stream into fractions containing different classes of sulfur-containing compounds with different reactivities relative to the conditions of hydrodesulfurization and oxidative desulfurization. Conventionally, most approaches subject the entire gas oil stream to the oxidation reactions, requiring unit operations that must be appropriately dimensioned to accommodate the full process flow.

Therefore, a need exists for an efficient and effective process and apparatus for desulfurization of hydrocarbon fuels to an ultra-low sulfur level.

Accordingly, it is an object of the present invention to desulfurize a hydrocarbon fuel stream containing different classes of sulfur-containing compounds having different reactivities, utilizing reactions separately directed to labile and refractory classes of sulfur-containing compounds.

It is a further object of the present invention to produce hydrocarbon fuels having an ultra-low sulfur level by targeted desulfurization of refractory organosulfur compounds using oxidative desulfurization, and desulfurization of labile organosulfur compounds using hydrodesulfurization under relatively mild conditions.

As used herein in relation to the apparatus and process of the present invention, the term "labile organosulfur compounds" means organosulfur compounds that can be easily desulfurized under relatively mild hydrodesulfurization pressure and temperature conditions, and the term "refractory organosulfur compounds" means organosulfur compounds that are relatively more difficult to desulfurize under mild hydrodesulfurization conditions.

Additionally, as used herein in relation to the apparatus and process of the present invention, the terms "mild hydrodesulfurization" and "mild operating conditions" when used in reference to hydrodesulfurization of a mid-distillate stream, i.e., boiling in the range of about 180° C. to about 370° C., generally means hydrodesulfurization processes operating at: a temperature of about 300° C. to about 400° C., preferably about 320° C. to about 380° C.; a reaction pressure of about 20 bars to about 100 bars, preferably about 30 bars to about 60 bars; a hydrogen partial pressure of below about 55 bars, preferably about 25 bars to about 40 bars; a feed rate of about 0.5 $hr^{-1}$ to about 10 $hr^{-1}$, preferably about 1.0 $hr^{-1}$ to about 4 $hr^{-1}$; and a hydrogen feed rate of about 100 liters of hydrogen per liter of oil (L/L) to about 1000 L/L, preferably about 200 L/L to about 300 L/L.

SUMMARY OF THE INVENTION

The above objects and further advantages are provided by the apparatus and process for desulfurization of hydrocarbon feeds containing both refractory and labile organosulfur compounds by mild hydrodesulfurization of a first targeted fraction to remove labile organosulfur compounds, and, substantially in parallel, oxidative desulfurization of a second targeted fraction to remove refractory organosulfur compounds.

According to the present invention, a cost-effective apparatus and process for reduction of sulfur levels of hydrocarbon streams includes integration of hydrodesulfurization with an oxidation reaction zone, in which the hydrocarbon sulfur-containing compounds are converted by oxidation to compounds containing sulfur and oxygen, such as sulfoxides or sulfones. The oxidized sulfur-containing compounds have different chemical and physical properties, which facilitate their removal from the balance of the hydrocarbon stream. Oxidized sulfur-containing compounds can be removed by extraction, distillation and/or adsorption.

The present invention comprehends an integrated system and process that is capable of efficiently and cost-effectively reducing the organosulfur content of hydrocarbon fuels. The cost of hydrotreating is minimized by reducing the volume of the original feedstream that is treated. Deep desulfurization of hydrocarbon fuels according to the present invention effectively optimizes use of integrated apparatus and processes, combining mild hydrodesulfurization and oxidative desulfurization. Most importantly, using the apparatus and process of the present invention, refiners can adapt existing hydrodesulfurization equipment and run such equipment under mild operating conditions. Accordingly hydrocarbon fuels are economically desulfurized to an ultra-low level.

Deep desulfurization of hydrocarbon feedstreams is achieved by first flashing a hydrocarbon stream at a target cut point temperature to obtain two fractions. A first fraction contains refractory organosulfur compounds, including 4,6-dimethyldibenzothiophene and its derivatives, which boil at or above the target cut point temperature. A second fraction boiling below the target cut point temperature is substantially free of refractory sulfur-containing compounds. The second fraction is contacted with a hydrodesulfurization catalyst in a hydrodesulfurization reaction zone operating at mild conditions to reduce the quantity of organosulfur compounds, primarily labile organosulfur compounds, to an ultra-low level. The first fraction is contacted with an oxidizing agent and an active metal catalyst in an oxidation reaction zone to convert the refractory organosulfur compounds to oxidized organosulfur compounds. The oxidized organosulfur compounds are removed, producing a stream containing an ultra-low level of organosulfur compounds. The two streams can be combined to obtain a full range hydrocarbon product containing an ultra-low level of organosulfur compounds.

The inclusion of a flashing column in an integrated system and process combining hydrodesulfurization and oxidative desulfurization allows a partition of the different classes of sulfur-containing compounds according to their respective reactivity factors, thereby optimizing utilization of the different types of desulfurization processes and hence resulting in a more cost effective process. The volumetric/mass flow through the oxidation reaction zone is reduced, since only the fraction of the original feedstream containing refractory sulfur-containing compounds is subjected to the oxidation process. As a result, the requisite equipment capacity, and accordingly both the capital equipment cost and the operating costs, are minimized. In addition, the total hydrocarbon stream is not subjected to oxidation reactions, thus avoiding unnecessary oxidation of organosulfur compounds that are otherwise desulfurized using mild hydrodesulfurization, which also minimizes the requirement to remove these oxidized organosulfur compounds.

Furthermore, product quality is improved by the integrated process of the present invention since undesired side reactions associated with oxidation of the entire feedstream under generally harsh conditions are avoided.

BRIEF DESCRIPTION OF THE DRAWINGS

The foregoing summary as well as the following detailed description of preferred embodiments of the invention will be best understood when read in conjunction with the attached drawings. For the purpose of illustrating the invention, there are shown in the drawings embodiments which are presently preferred. It should be understood, however, that the invention is not limited to the precise arrangements and apparatus shown. In the drawings the same numeral is used to refer to the same or similar elements, in which.

DETAILED DESCRIPTION OF THE INVENTION

The present invention comprehends an integrated desulfurization process to produce hydrocarbon fuels with an ultra-low level of sulfur which includes the following steps:

a. Flashing the hydrocarbon feedstock at a target cut point temperature of about 300° C. to about 360° C., preferably about 340° C., to obtain two fractions. The two fractions contain different classes of organosulfur compounds having different reactivities when subjected to hydrodesulfurization and oxidative desulfurization processes.

b. The organosulfur compounds in the fraction boiling below the target cut point temperature are primarily labile organosulfur compounds, including aliphatic molecules such as sulfides, disulfides, mercaptans, and certain aromatics such as thiophenes and alkyl derivatives of thiophenes. This fraction is contacted with a hydrodesulfurization catalyst in a hydrodesulfurization reaction zone under mild operating conditions to remove the organosulfur compounds.

c. The organosulfur compounds in the fraction boiling at or above the target cut point temperature are primarily refractory organosulfur compounds, including aromatic molecules such as certain benzothiophenes (e.g., long chain alkylated benzothiophenes), dibenzothiophene and alkyl derivatives, e.g., 4,6-dimethyldibenzothiophene. This fraction is contacted with an oxidizing agent and an active metal catalyst in an oxidation reaction zone to convert the organosulfur compounds into oxidized sulfur-containing compounds.

d. The oxidized organosulfur compounds are subsequently removed in a separation zone by oxidation product removal processes and apparatus that include extraction, distillation, adsorption, or combined processes comprising one or more of extraction, distillation and adsorption.

e. The resulting stream from the hydrodesulfurization reaction zone and the low sulfur stream from the separation zone can be recombined to produce an ultra-low sulfur level hydrocarbon product, e.g., a full-range diesel fuel product.

Figure 1:
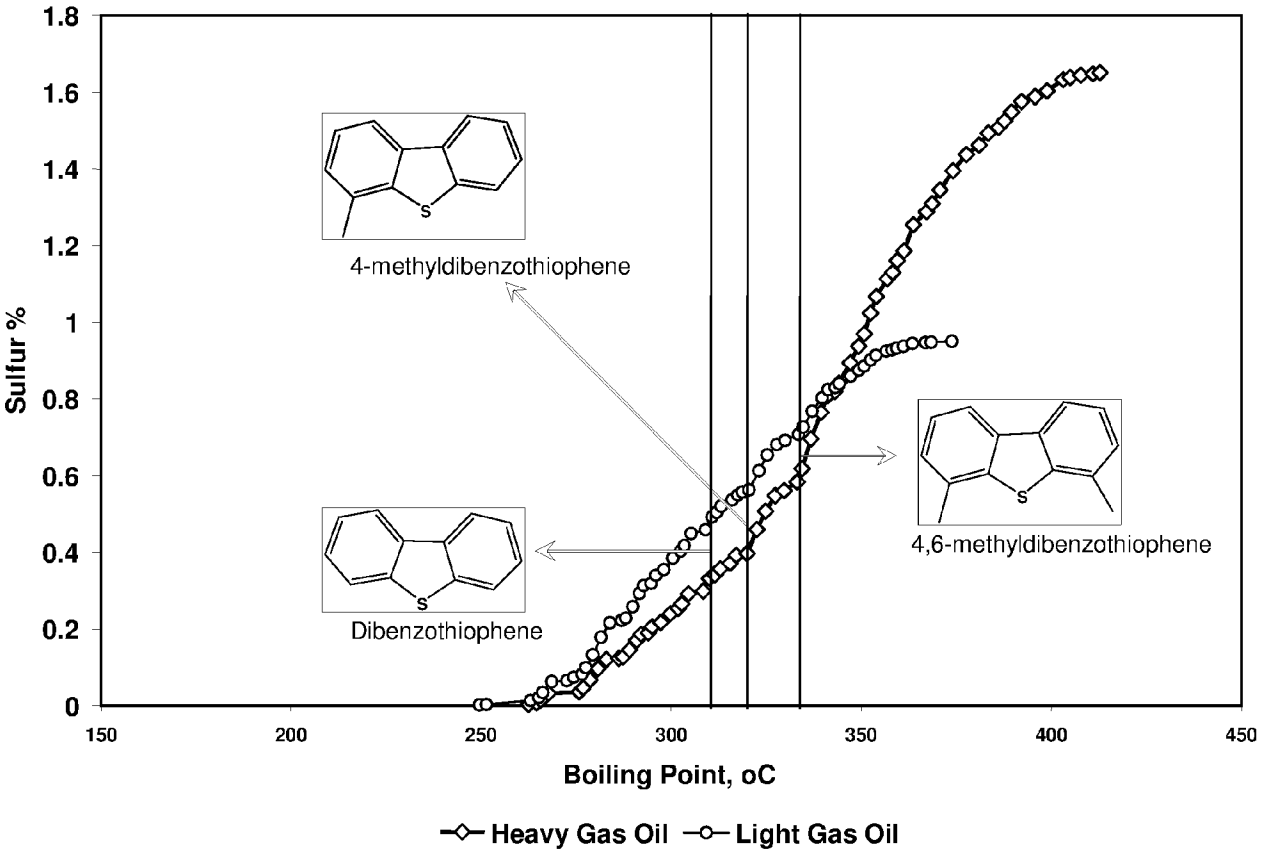
FIG. 1 PRIOR ART
FIG. 1 is a graph showing cumulative sulfur concentrations plotted against boiling points of three thiophenic compounds.
Figure 2:
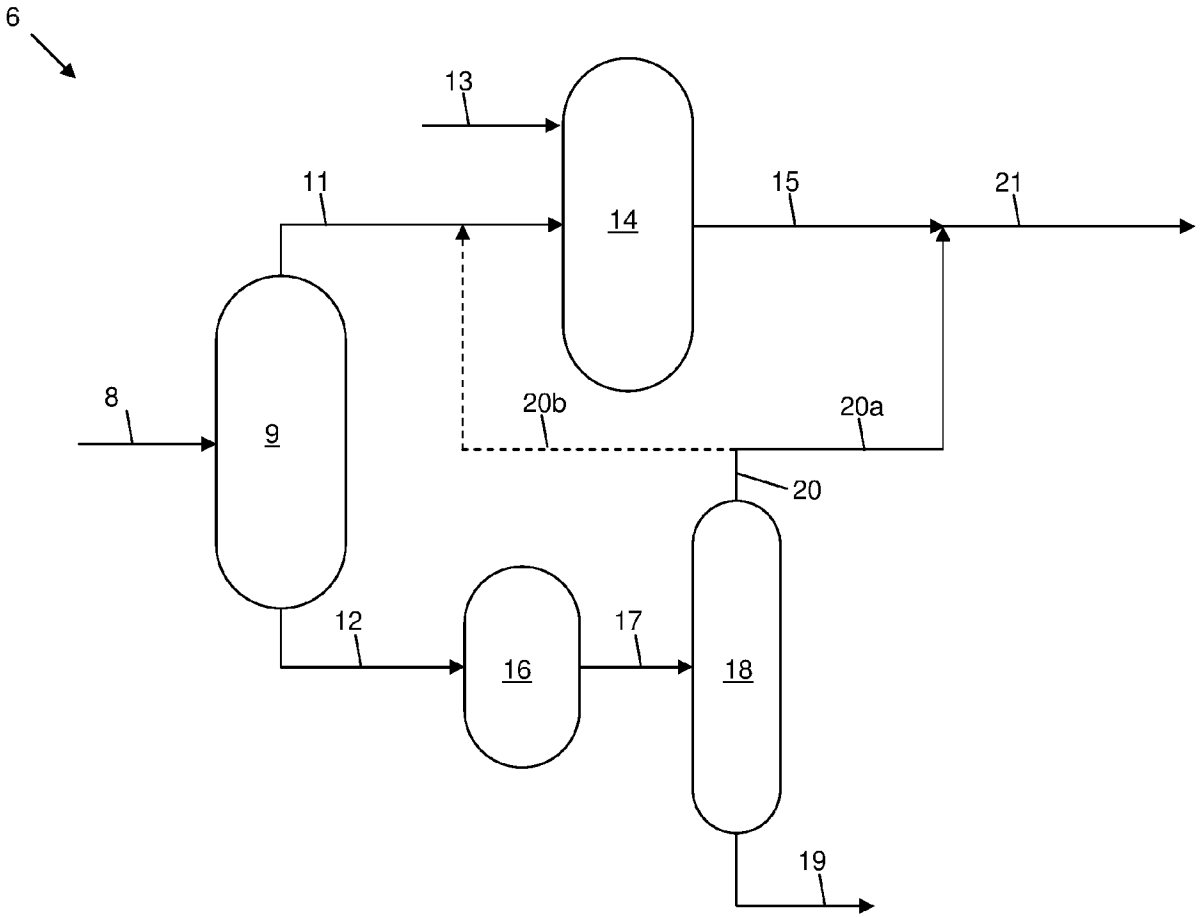
FIG. 2 is a schematic diagram of an integrated desulfurization system and process of the present invention that includes a flashing column upstream of the hydrodesulfurization and oxidative desulfurization zones.

Referring to FIG. 2, an integrated desulfurization apparatus 6 according to the present invention is schematically illustrated. Apparatus 6 includes a flashing column 9, a hydrodesulfurization reaction zone 14, an oxidative desulfurization reaction zone 16 and a separation zone 18. A hydrocarbon stream 8 is introduced into the flashing column 9 to be fractionated at a target cut point temperature of about 300° C. to about 360° C., and preferably about 340° C., into two streams 11 and 12. The hydrocarbon stream 9 is preferably a straight run gas oil boiling in the range of about 260° C. to about 450° C., typically containing up to about 2 weight % sulfur, although one of ordinary skill in the art will appreciated that other hydrocarbon streams can benefit from the practice of the system and method of the present invention.

Stream 11 boiling below the target cut point temperature is passed to the hydrodesulfurization reaction zone 14 and into contact with a hydrodesulfurization catalyst and a hydrogen feed stream 13. Since refractory organosulfur compounds are generally present in relatively low concentrations, if at all, in this fraction, hydrodesulfurization reaction zone 14 can operate under mild conditions. The hydrodesulfurization catalyst can be, for instance, an alumina base containing cobalt and molybdenum.

As will be understood by one of ordinary skill in the art, "mild" operating conditions is relative and the range of operating conditions depend on the feedstock being processed. According to the present invention, these mild operating conditions as used in conjunction with hydrotreating a mid-distillate stream, i.e., boiling in the range of about 180° C. to about 370° C., include: a temperature of about 300° C. to about 400° C., preferably about 320° C. to about 380° C.; a reaction pressure of about 20 bars to about 100 bars, preferably about 30 bars to about 60 bars; a hydrogen partial pressure of below about 55 bars, preferably about 25 bars to about 40 bars; a feed rate of about 0.5 $hr^{-1}$ to about 10 $hr^{-1}$, preferably about 1.0 $hr^{-1}$ to about 4 $hr^{-1}$; and a hydrogen feed rate of about 100 liters of hydrogen per liter of oil (L/L) to about 1000 L/L, preferably about 200 L/L to about 300 L/L.

The resulting hydrocarbon stream 15 contains an ultra-low level of organosulfur compounds, i.e., less than 15 ppmw, since substantially all of the aliphatic organosulfur compounds, and thiophenes, benzothiophenes and their derivatives boiling below the target cut point temperature, are removed. Stream 15 can be recovered separately or in combination with the portion boiling at or above the target cut point temperature that has been subjected to the oxidative desulfurization reaction zone 16.

Stream 12 boiling at or above the target cut point temperature is introduced into the oxidative desulfurization reaction zone 16 for contact with an oxidizing agent and one or more catalytically active metals. The oxidizing agent can be an aqueous oxidant such as hydrogen peroxide, organic peroxides such as ter-butyl hydroperoxide, or peroxo acids, a gaseous oxidant such as oxides of nitrogen, oxygen, or air, or combinations comprising any of these oxidants. The oxidation catalyst can be selected from one or more homogeneous or heterogeneous catalysts having metals from Group IVB to Group VIIIB of the Periodic Table, including those selected from of Mn, Co, Fe, Cr and Mo.

The higher boiling point fraction, the oxidizing agent and the oxidation catalyst are maintained in contact for a period of time that is sufficient to complete the oxidation reactions, generally about 15 to about 180 minutes, in certain embodiments about 15 to about 90 minutes and in further embodiments about 30 minutes. The reaction conditions of the oxidative desulfurization zone 16 include an operating pressure of about 1 to about 80 bars, in certain embodiments about 1 to about 30 bars, and in further embodiments at atmospheric pressure; and an operating temperature of about 30° C. to about 300° C., in certain embodiments about 30° C. to about 150° C. and in further embodiments about 80° C. The molar feed ratio of oxidizing agent to sulfur is generally about 1:1 to about 100:1, in certain embodiments about 1:1 to about 30:1, and in further embodiments about 4:1 to about 1:1. In the oxidative desulfurization zone 16, at least a substantial portion of the aromatic sulfur-containing compounds and their derivatives boiling at or above the target cut point are converted to oxidized sulfur-containing compounds, i.e. sulfones and sulfoxides and discharged as an oxidized hydrocarbon stream 17.

Stream 17 from the oxidative desulfurization zone 16 is passed to the separation zone 18 to remove the oxidized sulfur-containing compounds as discharge stream 19 and obtain a hydrocarbon stream 20 that contains an ultra-low level of sulfur, i.e., less than 15 ppmw. A stream **20*a* can recovered, or streams 15 and 20*a* can be combined to provide a hydrocarbon product 21 that contains an ultra-low level of sulfur that is recovered. A stream 20*b* can be recycled back to the hydrotreating zone 14 if the sulfur content of the oxidative desulfurization zone products remains high and needs to be further reduced. Stream 19 from the separation zone 18 is passed to a sulfones and sulfoxides handling unit (not shown) to recover hydrocarbons free of sulfur, for example, by cracking reactions, thereby increasing the total hydrocarbon product yield. Alternatively, stream 19** can be passed to other refining processes such as coking or solvent deasphalting.

Figure 3:
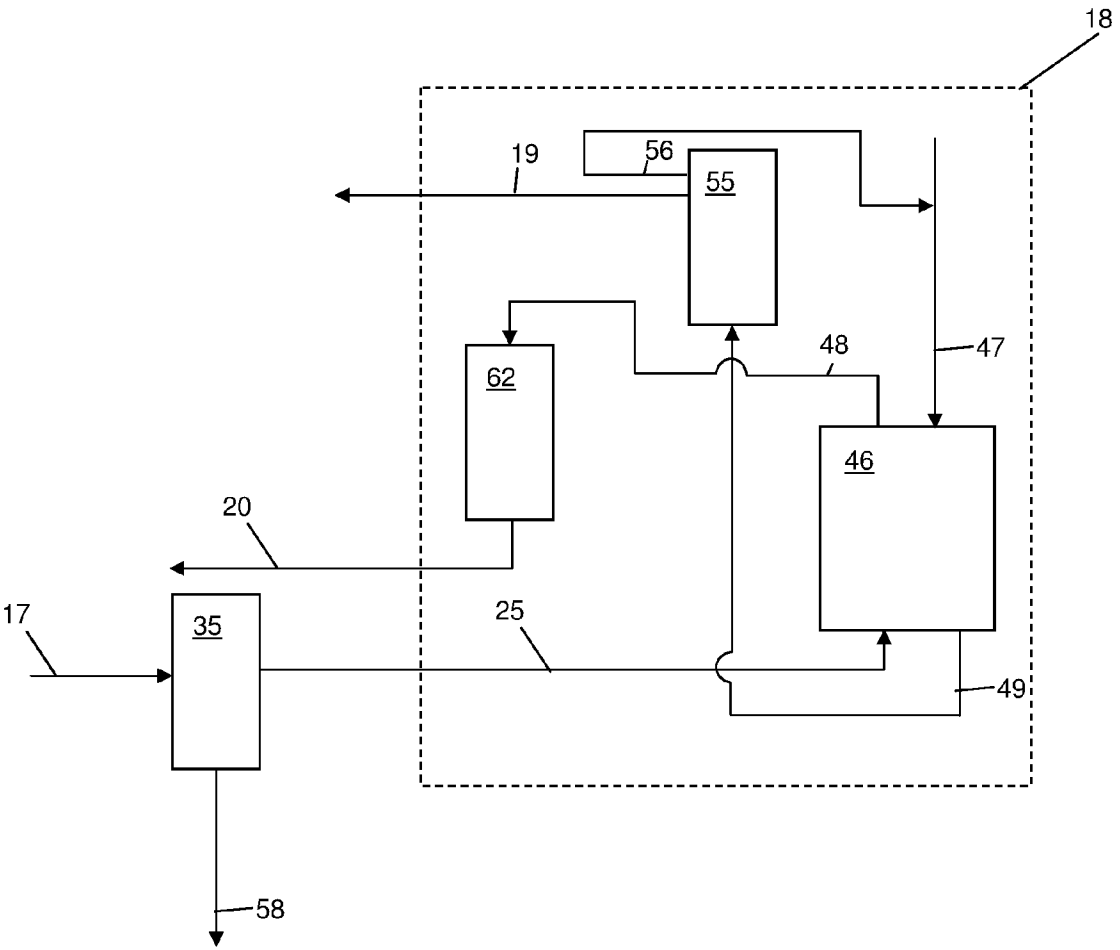
FIG. 3 is a schematic diagram of a separation apparatus for removing oxidized organosulfur compounds from a fraction boiling at or above the target cut point temperature according to the system and process of the present invention.

Referring to FIG. 3, one embodiment of a process for removing sulfoxides and sulfones from oxidized hydrocarbon stream 17 is shown. Stream 17 containing oxidized hydrocarbons, water and catalyst is introduced into is introduced into a decanting vessel 35 to decant water and catalyst as a discharge stream 58 and separate a hydrocarbon mixture stream 25. Stream 58 which can include a mixture of water (e.g., from the aqueous oxidant), any remaining oxidant and soluble catalyst, is withdrawn from the decanting vessel 35 and recycled to the oxidative desulfurization zone 16 (not shown in FIG. 3), and the hydrocarbon stream 25 is passed generally to the separation zone 18. The hydrocarbon stream 25 is introduced into one end of a counter-current extractor 46, and a solvent stream 47 is introduced into the opposite end. Oxidized sulfur-containing compounds are extracted from the hydrocarbon stream with the solvent as solvent-rich extract stream 49.

The solvent stream 47 can include a selective solvent such as methanol, acetonitrile, any polar solvent having a Hildebrandt value of at least 19, and combinations comprising at least one of the foregoing solvents. Acetonitrile and methanol are preferred solvents for the extraction due to their polarity, volatility, and low cost. The efficiency of the separation between the sulfones and/or sulfoxides can be optimized by selecting solvents having desirable properties including, but not limited to boiling point, freezing point, viscosity, and surface tension.

The raffinate 48 is introduced into an adsorption column 62 where it is contacted with an adsorbent material such as an alumina adsorbent to produce the finished hydrocarbon product stream 20 that has an ultra-low level of sulfur, which is recovered. The solvent-rich extract 49 from the extractor 46 is introduced into the distillation column 55 for solvent recovery via the overhead recycle stream 56, and the oxidized sulfur-containing compounds, i.e., sulfones and/or sulfoxides are discharged as stream 19.

The addition of a flash column into the apparatus and process of the invention that integrates a hydrodesulfurization zone and an oxidative desulfurization zone uses low cost units in both zones as well as more favorable conditions in the hydrodesulfurization zone, i.e., milder pressure and temperature and reduced hydrogen consumption. Only the fraction boiling at or above the target cut point temperature is oxidized to convert the refractory sulfur-containing compounds. This results in more cost-effective desulfurization of hydrocarbon fuels, particularly removal of the refractory sulfur-containing compounds, thereby efficiently and economically achieving ultra-low sulfur content fuel products.

The present invention offers distinct advantages when compared to conventional processes for deep desulfurization of hydrocarbon fuel. For example, in certain conventional approaches to deep desulfurization, the entire hydrocarbon stream undergoes both hydrodesulfurization and oxidative desulfurization, requiring reactors of high capacity for both processes. Furthermore, the high operating costs and undesired side reactions that can negatively impact certain desired fuel characteristics are avoided using the process and apparatus of the present invention. In addition, operating costs associated with the removal of the oxidized sulfur-containing compounds from the entire feedstream are decreased as only a portion of the initial feed is subjected to oxidative desulfurization.

EXAMPLE

A gas oil was fractionated in an atmospheric distillation column to split the gas oil into two fractions: A light gas oil fraction (LGO) that boils at 340° C. and less with 92.6 W % yield and a heavy gas oil fraction (HGO) that boils at 340° C. and higher with 7.4 W % yield were obtained. The LGO boiling 340° C. or less was desulfurized, the properties of which are given in Table 4.

TABLE 4

| Property | Unit | SR Gas Oil Value | 340° C. − Value | 340° C. + Value |
|---|---|---|---|---|
| Yield | W % | 100 | 92.6 | 7.4 |
| Sulfur | W % | 0.72 | 0.625 | 1.9 |
| Density | g/cc | 0.82 | 0.814 | 0.885 |
| 5% | ° C. | 138 | 150 | 332 |
| 10% | ° C. | 166 | 173 | 338 |
| 30% | ° C. | 218 | 217 | 347 |
| 50% | ° C. | 253 | 244 | 355 |
| 70% | ° C. | 282 | 272 | 363 |
| 90% | ° C. | 317 | 313 | 379 |
| 95% | ° C. | 360 | 324 | 389 |

The LGO fraction was subjected to hydrodesulfurization in a hydrotreating vessel using an alumina catalyst promoted with cobalt and molybdenum metals at 30 $Kg/cm^2$ hydrogen partial pressure at the reactor outlet, weighted average bed temperature of 335° C., liquid hourly space velocity of 1.0 $h^{-1}$ and a hydrogen feed rate of 300 L/L. The sulfur content of the gas oil was reduced to 10 ppmw from 6,250 ppmw.

The HGO fraction contained diaromatic sulfur-containing compounds (benzothiophenes) and triaromatic sulfur-containing compounds (dibenzothiophenes) with latter one being the most abundant species (~80%) according to speciation using a two dimensional gas chromatography equipped with a flame photometric detector. Further analysis by gas chromatography integrated with a mass spectroscopy showed that benzothiophene compounds are substituted with alkyl chains equivalent to four and more methyl groups.

The heavy gas oil fraction, the properties of which are given in Table 4, was oxidized in a reactor at 80° C. and 1 atmosphere for 1.5 hour. 0.5 W % of $Na_2WO_4$, $2H_2O$ and 13 W % of acetic acid are used as catalytic system. A 30% $H_2O_2/H_2O$ mixture is used as oxidizing agent targeting peroxide to sulfur molar ratio of 4. After the oxidation reaction, the reaction medium was cooled to room temperature and the layers were separated. The oil layer that contained the oxidized sulfur-containing compounds underwent an extraction step using methanol (1:1 V/V % ratio of oil to solvent ratio) at room temperature. Adsorption of remaining sulfur-containing compounds over $\gamma$-$Al_2O_3$ in an oil layer after solvent extraction was carried out at room temperature in a chromatography column, equipped with a coarse bottom frit (10:1 ratio of oil and adsorbent).

The sulfur content of the oil layer after oxidation was reduced to 1.03 wt % from 1.9 wt % in the original heavy gas oil fraction. It was then further reduced to 0.31 wt % after methanol extractions and to 0.28 wt % after adsorption. The oil fraction, which is free of refractory sulfur-containing compounds but still contains labile sulfur-containing compounds, was recycled back to the hydrotreating unit for desulfurization. The process yielded a diesel product with a sulfur content of 10 ppmw.

The method and system of the present invention have been described above and in the attached drawings; however, modifications will be apparent to those of ordinary skill in the art and the scope of protection for the invention is to be defined by the claims that follow.

The invention claimed is:

1. An apparatus for processing a hydrocarbon feed containing undesired organosulfur compounds comprising:

a flashing column operable to flash the hydrocarbon feed at a temperature cut point of about 320° C. to about 360° C., the flashing column including an inlet for receiving the hydrocarbon feed, a low boiling temperature outlet for discharging a low boiling temperature fraction containing labile organosulfur compounds, and a high boiling temperature outlet for discharging a high boiling temperature fraction containing refractory organosulfur compounds;

a hydrodesulfurization zone having an inlet in fluid communication with the low boiling temperature outlet and an outlet for discharging hydrotreated effluent; and an oxidative desulfurization zone containing an oxidation catalyst and an oxidizing agent, oxidative desulfurization zone having an inlet in fluid communication with the high boiling temperature outlet and an outlet for discharging oxidized effluent; and a solvent extraction zone having a product inlet in fluid communication with the outlet for discharging oxidized effluent, a solvent inlet in fluid communication with a source of polar solvent, an extract outlet for discharging a mixture of solvent and oxidized sulfur-containing compounds, and a raffinate outlet for discharging a solvent extracted hydrocarbon product stream.

2. The apparatus as in claim 1, further comprising a distillation column having an inlet in fluid communication with the extract outlet, a byproduct outlet for discharging oxidized sulfur-containing compounds, and a solvent outlet, wherein the solvent outlet is the source of polar solvent and is in fluid communication with the solvent inlet of the solvent extraction zone.

3. The apparatus as in claim 1, further comprising an adsorption zone having an inlet in fluid communication with the raffinate outlet of the solvent extraction zone, and a product outlet for discharging an adsorbent treated hydrocarbon product stream.

4. The apparatus as in claim 1, further comprising a decanting vessel between the oxidative desulfurization zone and the solvent extraction zone having an inlet in fluid communication with the outlet for discharging oxidized effluent and an outlet in fluid communication with the product inlet of the solvent extraction zone.

5. The apparatus of claim 1, wherein the oxidizing agent is selected from the group consisting of hydrogen peroxide, organic peroxides such as ter-butyl hydroperoxide, peroxo acids, oxides of nitrogen, oxygen, and air.

6. The apparatus of claim 1, wherein the oxidizing catalyst is selected from the group consisting of homogeneous catalysts and heterogeneous catalysts.

7. The apparatus of claim 6, wherein the oxidizing catalyst includes a metal from Group IVB to Group VIIIB of the Periodic Table.

* * * * *